US005653209A

United States Patent [19]

Johansson et al.

[11] Patent Number: 5,653,209

[45] Date of Patent: Aug. 5, 1997

[54] METHOD AND SYSTEM FOR AN ADAPTIVE FUEL CONTROL IN TWO-STROKE ENGINES

[75] Inventors: Hans Johansson; Jan Nytomt, both of Amal, Sweden

[73] Assignee: Mecel AB, Sweden

[21] Appl. No.: 624,612

[22] PCT Filed: Aug. 8, 1995

[86] PCT No.: PCT/SE95/00915

§ 371 Date: Apr. 11, 1996

§ 102(e) Date: Apr. 11, 1996

[87] PCT Pub. No.: WO96/05419

PCT Pub. Date: Feb. 22, 1996

[30] Foreign Application Priority Data

Aug. 11, 1994 [SE] Sweden ..... 9402688

[51] Int. Cl.[6] ..... F02D 41/14

[52] U.S. Cl. ..... 123/435

[58] Field of Search ..... 123/435

[56] References Cited

U.S. PATENT DOCUMENTS

| | | | |
|---|---|---|---|
| 4,243,009 | 1/1981 | Staerzl | 123/435 |
| 4,964,387 | 10/1990 | Hansen | 123/425 |
| 5,174,261 | 12/1992 | Fuji et al. | 123/435 |

*Primary Examiner*—Andrew M. Dolinar

*Attorney, Agent, or Firm*—Ostrolenk, Faber, Gerb & Soffen, LLP

[57] ABSTRACT

A method and system for adaptive correction of the amount of fuel supplied in two-stroke combustion engines which during a continuous operation period regulates the air-fuel mixture regulated by increments in the lean direction ($\Delta F^-$) or in the rich direction ($\Delta F^+$), whereby fuel amounts (F) are established which cause knocking (KNOCK) and four-stroking or misfiring (4-ST), respectively. These limit values are stored as a lean limit value $M_{FK}$ and a rich limit value $M_{F4ST}$, respectively. For further operation of the combustion engine, a corrected fuel amount $F_{koor}$, is used, which is corrected in relation to the fuel amount $F_{tab}$ given from an empirically determined value stored in a map, and dependent on the established lean limit value $M_{FK}$ and the rich limit value $M_{F4ST}$, respectively. The fuel amount (F) supplied will suitably be given according to the function: $F=F_{korr}=M_{FK}+K\cdot(M_{F4ST}-M_{FK})$, where K is a margin factor which defines if further operation of the engine will be controlled having an equidistant margin towards a knocking condition or a four-stroking or misfire condition, i.e., if K is set to a value of 0.5, or if further operation will be controlled toward leaner air-fuel ratios, i.e., if K is set to a value below 0.5. Further control could thus be made having a fixed relative margin towards a knocking condition as well as a four-stroking condition.

11 Claims, 2 Drawing Sheets

METHOD AND SYSTEM FOR AN ADAPTIVE FUEL CONTROL IN TWO-STROKE ENGINES

The present invention relates to a method and system for fuel control in two-stroke engines.

For larger combustion engines in vehicles relatively complicated systems are used in order to reduce emission levels and fuel consumption. A feedback system having a lambda sensor in the exhaust system, is often used. The lambda sensor is used to control that the proper air-fuel ratio is maintained, whereby a three-way catalytic reactor could operate at optimum efficiency.

For smaller and less expensive two-stroke engines, for example used in hand held garden machines, it becomes considerably more difficult to obtain a control system that will not dramatically affect the cost for the propulsion unit. Control systems with lambda sensors are comparatively expensive, and the lambda sensor is sensitive to fuel contamination. The major problem in two-stroke engines is that relatively large mounts of unburned hydrocarbons are exhausted. This is caused by the two-stroke engines having rather simple type of control systems, and often optimised for driveability at the expense of increased content of hydrocarbons in the exhaust. Controlling air-fuel ratios in the lean direction often results in reduction of unburned hydrocarbons in the exhaust. At the same time driveability will decrease when controlling in the lean direction, and the risk for engine damages increases.

In control systems where the control in the lean direction only is made towards the knock limit, in order to reduce emissions, a knocking condition is ceased by increasing the fuel amount. The increase of the fuel amount could in certain operating cases come close to or exceed the amount of fuel that cause a four-stroking condition.

SUMMARY OF THE INVENTION

An object of the invention is to obtain an optimal control of a two-stroke combustion engine as of the amount of fuel supplied. The optimal amount of fuel supplied is adapted to the fuel quality, the temperature of the combustion engine and the condition of the spark plug. Another object is to obtain an adaptive control system for two-stroke engines, which control system on a regular basis could establish feedback reference signals regarding the extreme limits for lean-and rich air-fuel ratios.

Yet another object is that the performance of control of the combustion engine could be based upon feedback information representative for the air-fuel ratio A/F, without using lambda sensors. A cost efficient and inexpensive control system could thus be construed and implemented also for smaller two-stroke engines without increasing the cost dramatically for such engines.

Yet another object is to obtain a reduction of unburned hydrocarbons in the exhaust from two-stroke engines, which also will cause reduction of the fuel consumption, while maintaining driveability at an optimal high level at the prevailing conditions.

The foregoing and other objects are achieved in accordance with the invention by a method for fuel control in two stroke combustion engines which includes supplying an empirically determined fuel amount ($F_{tab}$) to the engine dependent on detected engine parameters. This fuel amount is reduced by a reduction ($\Delta F$) in the lean direction of the empirically determined amount of fuel ($F_{tab}$) until a knocking condition occurs. This amount of fuel is then stored in memory as a value ($M_{FK}$). The fuel amount is then increased by an increase ($\Delta F+$) in the rich direction of the empirically determined amount of fuel ($F_{tab}$) until the two stroke engine starts four stroking due to misfire. This value is then stored in memory as a rich limit value ($M_{F4ST}$). An adaptive set value ($F_{korr}$) is then calculated, which adaptive set value lies at a predetermined level between the rich limit value ($M_{F4ST}$) and the lean limit value ($M_{fk}$). The adaptive set value ($F_{korr}$) is stored in memory and this value compared with the empirically determined amount of fuel (F) and, when a deviation occurs, the empirically determined amount of fuel is corrected proportionally to the deviation between the adaptive set value ($F_{korr}$) and the empirically determined amount of fuel ($F_{tab}$).

The invention is also directed to a system for controlling the amount of fuel supplied in a two stroke engine, which comprises a micro processor base control unit having a memory which contains a map of predetermined amounts of fuel dependent on at least different detected engine speeds and loads. Means are provided for detecting a knocking condition and supplying a signal representative of the knocking condition to the control unit. Means are also provided for detecting a misfire or four-stroking condition and supplying a signal representative of such condition to the control unit. The control unit further includes means for controlling the fuel in the lean direction and, when a signal representative of knocking condition occurs, for allocating a value to a lean limit parameter ($M_{FK}$) representative of the present amount of fuel supplied. The control unit further includes means for controlling of the fuel in the rich direction and, when a signal representative of a misfire condition or four stroking condition occurs, for allocating a value to a rich limit parameter ($M_{F4ST}$) representative of the present amount of fuel supplied. The control unit further includes means for calculating a corrected amount of fuel ($F_{korr}$) which is dependent on a predetermined relative level in relation to the allocated values of the rich limit parameter ($M_{F4ST}$) and the lean limit parameter ($M_{FK}$), the corrected amount of fuel ($F_{korr}$) being substituted for the fuel amount given by the map during further continuous operation of the engine.

By the inventive method and the system for the performance of the method optimal driveability could be obtained as well as minimised levels of hydrocarbon emissions and fuel consumption. Driveability increases up until a certain limit of rich air-fuel ratio, while the emission levels decreases at leaner air-fuel ratios. By establishment of the rich limit of the air-fuel mixture, causing four-stroking of the engine, and the lean limit of the air-fuel ratio, causing a knocking condition in the engine, could the optimal amount of fuel be established. The optimal amount of fuel could then be determined having predetermined margins towards the four-stroking limit as well as towards the knocking limit. This is advantageous for combustion engines operating with different qualities of fuel, and different types of ignition plugs, ignition gaps and varying ambient temperatures, etc. These different conditions of operation could lead to that the possible control range of the fuel amount supplied, ranging from a lower amount of fuel causing a knocking condition to a larger amount of fuel causing a four-stroking condition, could show considerable differences in the size of the control range. The control according to the inventive method will maintain a constant relative margin towards a knocking condition as well as a four-stroking or misfire condition, irrespective of the size of the possible control range.

Other features and advantages of the present invention will become apparent from the following description of the invention which refers to the accompanying drawings.

DESCRIPTION OF PREFERRED EMBODIMENT(S)

Figure 1:
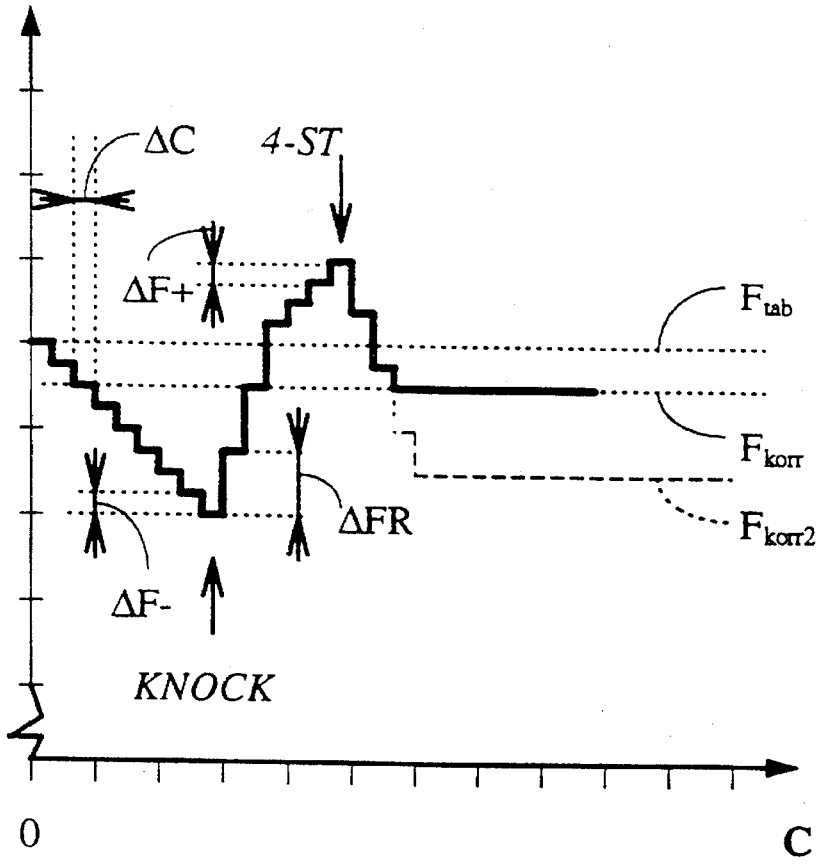
FIG. 1 shows how the amount of fuel by forced control in steps ΔF/ΔF+/ΔFR is controlled to a knocking condition KNOCK, respectively a four-stroking condition 4-ST.

In FIG. 1 is shown how the amount of fuel F supplied, is controlled according to the inventive method, which method more closely is described by reference to the flow-chart shown in FIG. 2.

In FIG. 1 the order of combustion C is specified at the horizontal X-axis, and at the vertical Y-axis is specified the present amount of fuel supplied. At the starting point, which corresponds to the step 20 in FIG. 2 and the combustion of order 0 at the X-axis in FIG. 1, a fuel amount $F_{tab}$ is supplied, given by a stored fuel map or table established from and dependent on detected engine parameters. The fuel map is in a conventionally manner an empirically established map, where the map for each type of engine and application is established from extensive tests.

The method will proceed to step 22 when a substantially constant load case, so called steady state, is detected in step 21. A steady state is defined by the engine not being subjected to a transient load case, such as acceleration or pulsating load. In step 22 the present amount of fuel F supplied will be set to the fuel amount $F_{tab}$ given by the map. The constant load case could be considered as a prevailing condition when speed- and load fluctuations are within predetermined limits, preferably less than 5–10% of the present speed or load. The start is thus dependent on prevailing conditions, i.e. that a substantially constant load case exist.

A reduction of the amount of fuel supplied is thereafter made with a predetermined increment $\Delta F^-$. After having supplied the reduced amount of fuel a control is made in step 24 if a knocking condition has occurred due to the reduction. The knocking condition is an uncontrolled combustion that could be detected by vibration sensitive sensors mounted at the engine block or by analysing the ionisation current in the combustion chamber with a detection circuit similar to the circuit shown in EP,B,188180. On the other hand it is desirable in certain type of applications, where emissions and fuel consumption are considered, to lie as close as possible to the knock limit, but at a safe distance thereof. An optimal lean air-fuel ratio will thus be obtained, without running a risk of a knocking condition appearing, which is damaging to the engine.

If a knocking condition is not detected in step 24, the programme will proceed to step 25 wherein a hold parameter C is updated at each execution of step 25. The hold parameter C could preferably correspond to one power stroke of the combustion engine, in such a way that for each ignition the hold parameter C is increased by a value of 1. A control is thereafter made in step 26 if the hold parameter has reached a predetermined number ΔC of power strokes, and as long as this number of power strokes has not been performed the program will return to step 25. The hold loop 25–26 will thus lead to that the reduced amount of fuel will be supplied during a number of combustion's dependent on the predetermined factor ΔC, whereby any dynamically induced effects from the reduction could attenuate properly. ΔC is preferably set to a couple of tens of power strokes.

After the hold loop 25–26 has supplied the present reduced amount of fuel for a number ΔC of power strokes, then the programme will return to step 23 where a further reduction of the amount of fuel supplied is made with the predetermined increment $\Delta F^-$. The steps 23–26 will consequently be repeated while successively reducing the amount of fuel supplied by the predetermined increment $\Delta F^-$, which each reduced amount of fuel is supplied for a number ΔC of power strokes.

When a knocking condition is detected in step 24, which knocking condition (KNOCK) in FIG. 1 occurs after 8 successive reductions of the empirically determined amount of fuel $F_{tab}$, by the increment $\Delta F^-$, the successive reduction of fuel is interrupted and the programme proceeds to step 27. In step 27 the present fuel amount F supplied is stored in a memory $M_{FK}$, which amount of fuel is the lean amount of fuel which will develop a knocking condition. $M_{FK}$ is hereafter designated as the lean limit value.

The programme will thereafter proceed to step 28 where the fuel amount supplied will be returned to the fuel amount $F_{tab}$ as given by the map. The return sequence is preferably performed in steps having a predetermined increment ΔFR, in order not to cause sudden changes between an extreme lean operation and the empirically determined ideal operation as given by the stored map. The return sequence will thus be obtained in a successively manner until the present amount of fuel supplied corresponds to the fuel amount $F_{tab}$ given by the stored map.

The successive return sequences do not necessarily have to be as lengthy as the successive reduction in the lean direction towards the knocking limit, as caused by the hold loop 25–26. The return sequence is performed towards an ideal condition and not towards an extreme condition having a lean limit air-fuel ratio where an exact determination of the lean limit value is desired. The return sequence from a knocking condition (KNOCK) could thus be performed by increasing the amount of fuel supplied with the increment ΔFR for each successive combustion, as shown in FIG. 1.

As could be seen in FIG. 1 is $\Delta F^-$ smaller than ΔFR, which is the most advantageous implementation, by which the knocking limit will be approached in a cautious manner in order to obtain a proper establishment of the lean limit value $M_{FK}$, while the return sequence could be performed as quick as possible but nevertheless obtaining a smooth control of the engine.

When the return sequence have reached the fuel amount $F_{tab}$ given by the map, which is detected in step 29, then the programme proceeds to step 30 where the fuel amount F supplied is increased by a predetermined increment $\Delta F^+$. During a gradual control in the rich direction of the air-fuel ratio, one will finally reach a condition where the engine starts to misfire, or if it is a two-stroke engine the engine will start a four-stroking process, i.e. only ignite after every second compression phase. After the supply of the increased amount of fuel a control is made in step 31 if the increases have induced a misfire or a four-stroking (4-ST) condition. Misfire or a four-stroking condition could be detected in a similarly manner as the knocking condition by analysing the ionisation current in the combustion chamber with a detection circuit similar to the circuit shown in EP,B,188180. No ionisation current will be developed during a misfire.

If a misfire or four-stroking condition is not detected in step 31 then the programme will proceed to a hold loop 32–33 corresponding to the hold loop 25–26. The hold parameter C and the predetermined hold factor ΔC are preferably identical in the hold loop 25–26 respectively in the hold loop 32–33. In a similar manner will the increased amount of fuel be supplied during a number of combustion's dependent of the predetermined factor ΔC, whereby any dynamically induced effects from the increase could attenuate properly.

After the hold loop 32–33 has supplied the present increased amount of fuel for a number ΔC of combustion's, then the programme will return to step 30 where a further increase of the amount of fuel supplied is made with the predetermined increment $\Delta F^+$, which each successively increased amount of fuel is supplied for a number ΔC of combustion's.

When a misfire or four-stroking condition is detected in step 31, the successive increase of fuel is interrupted and the programme proceeds to step 34. In step 34 the present fuel amount F supplied is stored in a memory $M_{F4ST}$, which amount of fuel is the rich amount of fuel which will develop a misfire or four-stroking condition. $M_{F4ST}$ is hereafter designated as the rich limit value.

At this stage a lean limit value $M_{FK}$ as well as a rich limit value $M_{F4ST}$ have been stored in memories. A numerical calculation of a corrected optimal amount of fuel $F_{korr}$ could then be performed. The corrected amount of fuel $F_{korr}$ could be adapted to the prevailing operating conditions, in such a manner that safe and secure margins are obtained in relation to a knocking condition or a misfiring or four-stroking condition.

The programme proceeds to step 35 where this calculation of $F_{korr}$ is performed. $F_{korr}$ could preferably be calculated by adding up the lean limit value $M_{FK}$ with a part of the difference between the rich limit value $M_{F4ST}$ and the lean limit value $M_{FK}$. Said part of the difference being obtained by multiplying the difference with a predetermined margin factor K, according;

$$F_{korr}=M_{FK}+K\cdot(M_{F4ST}-M_{FK})$$

The margin factor K could for each type of application or engine be selected according to the determining criteria for the functionality of the engine. If for example an optimal margin in relation to a knocking condition as well as misfiring condition is desirable, could the margin factor be set to 0.5. A margin factor of 0.5 will give a fuel amount $F_{korr}$ according to FIG. 1, in relation to the lean limit value $M_{FK}$ and the rich limit value $M_{F4ST}$. The fuel amount is here half-way between the lean limit value $M_{FK}$ and the rich limit value $M_{F4ST}$.

If instead an optimal lean air-fuel ratio is desired, which could be desirable if harsh emission demands are made for the combustion engine, the margin factor could instead be set to a value in the range 0.15–0.20. A margin factor in the range 0.15–0.20 will give a fuel amount $F_{korr2}$ according to FIG. 1, in relation to the lean limit value $M_{FK}$ and the rich limit value $M_{F4ST}$. The fuel amount $F_{korr2}$ is here slightly above the lean limit value, 15–20% of the difference between the rich limit value $M_{F4ST}$ and the lean limit value $M_{FK}$.

The margin factor K could also be a variable factor dependent on engine parameters, for example dependent on engine temperature $K(t_m)$, or engine temperature and inlet air temperature $K(t_m,t_1)$.

After having calculated the corrected amount of fuel $F_{korr}$ in step 35, then the programme proceeds to step 36, where a return sequence is initiated which will adjust the fuel amount supplied to the corrected amount of fuel $F_{korr}$. The return sequence is preferably performed in steps having a predetermined increment ΔFR, in a similar manner as performed in the return sequence in steps 28–29. Detection is made in step 37 if the amount of fuel supplied has reached the corrected amount of fuel. As long as this corrected amount of fuel has not been reached a reduction of the amount of fuel supplied will be made with the increment ΔFR, and possibly reduced for each successive combustion.

When the amount of fuel supplied corresponds to the corrected amount of fuel $F_{korr}$, as established from the detected rich limit value and the lean limit value, then the programme in step 38 will return to the main programme. The set value stored in the map could possibly be corrected in the main programme, or alternatively could a correction factor $K_F$ be stored and established according;

$$K_F=F_{korr}/F_{tab}$$

The correction factor $K_F$ could thereafter be used for the entire map, for each fuel amount in question given by the map, irrespective of changes in speed or load. In an alternative mode of operation could a number of correction factors be established for several different combinations of speed and load, where correction factors for speed and load cases in between are established by linear interpolation. The correction factor $K_F$ could in a similarly manner as the margin factor K be dependent of engine temperature and possibly also the inlet air temperature, as $K_f(t_m, t_1)$.

Figure 2:
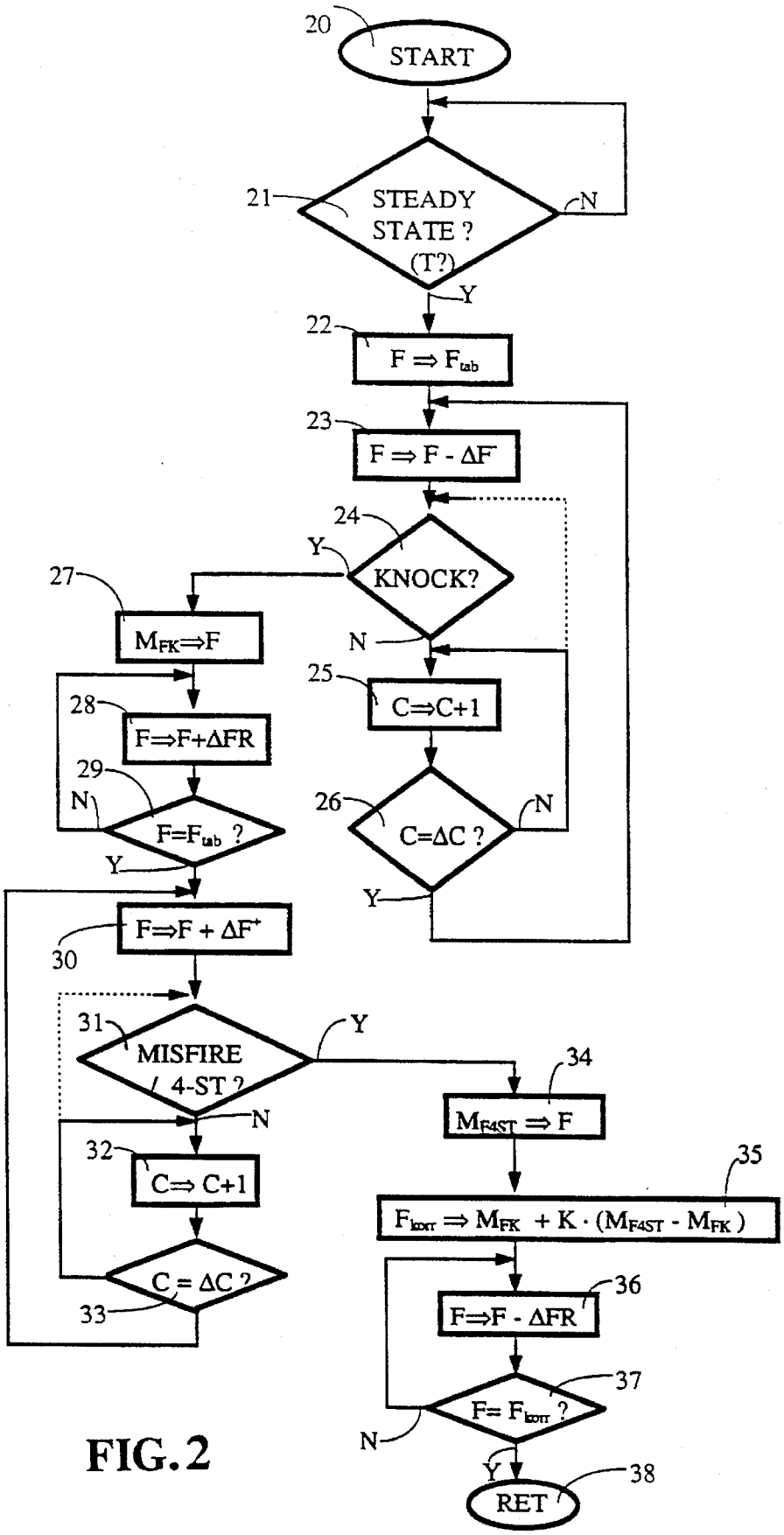
FIG. 2 shows a flow-chart for the inventive method.

In FIG. 2 the loop 25–26 as well as the loop 32–33 are also shown in a modified alternative embodiment, relating to updating of the hold parameter C. The programme could preferably return to step 24 or step 31 after each update of the hold parameter C. This procedure would enable detection of a knocking condition or misfiring or four-stroking condition occurring during the time when the latest execution of reduction or increase of the fuel amount is allowed to come into effect. This alternative is shown by dotted flow arrows. In this manner a further reduction or increase of the fuel amount is avoided, if a knocking or four-stroking condition occurs during the updating sequence of the hold parameter to the value ΔC.

The hold parameter is set to a zero value preferably automatically at each start of the main programme, and when the hold factor ΔC in steps 26 or 33 have been reached.

Establishment of the rich limit value $M_{F4ST}$ and the lean limit value $M_{FK}$ is made repeatedly during one and the same continuous operating period of the engine. The repetition rate is determined by a predetermined function that will restrict the number of occasions when this establishment is made over a time period. The establishment of the values should only occur during fractions of the total operating time of the engine. Said fraction being less than 5% of the total operating time, and preferably no more than 1% of the total operating time. A control could be made in step 21 for this purpose, where a control is made if a certain time T has elapsed since the latest establishment of the corrected fuel amount $F_{korr}$. The step 21 contains a two-part condition, a load condition and a time condition, where both of these conditions must be fulfilled before a new establishment of $F_{korr}$ is made. In this way is assured that the engine is not frequently forced away from ideal operating conditions. This is advantageous for hand-held two-stroke engines, which often are operating over longer time intervals at a substantially constant load case. When a two-stroke engine has reached normal operating temperature, then the operating conditions usually only change after a comparatively long time period. This will lead to that a new establishment of $F_{korr}$ only needs to be performed after very long intervals.

During the warm up period of the combustion engine, or whenever dT/dt, preferably the first order derivative of the engine temperature, has a comparatively high value, a new establishment of $F_{korr}$ is performed at shorter intervals. The predetermined time T in step 21 could be dependent or the temperature $T(m_t)$ in such a way that T is set to very short time value until the engine reaches its normal operating temperature. The time T could possibly assume successively longer time values as the engine temperature approaches the normal operating temperature.

Figure 3:
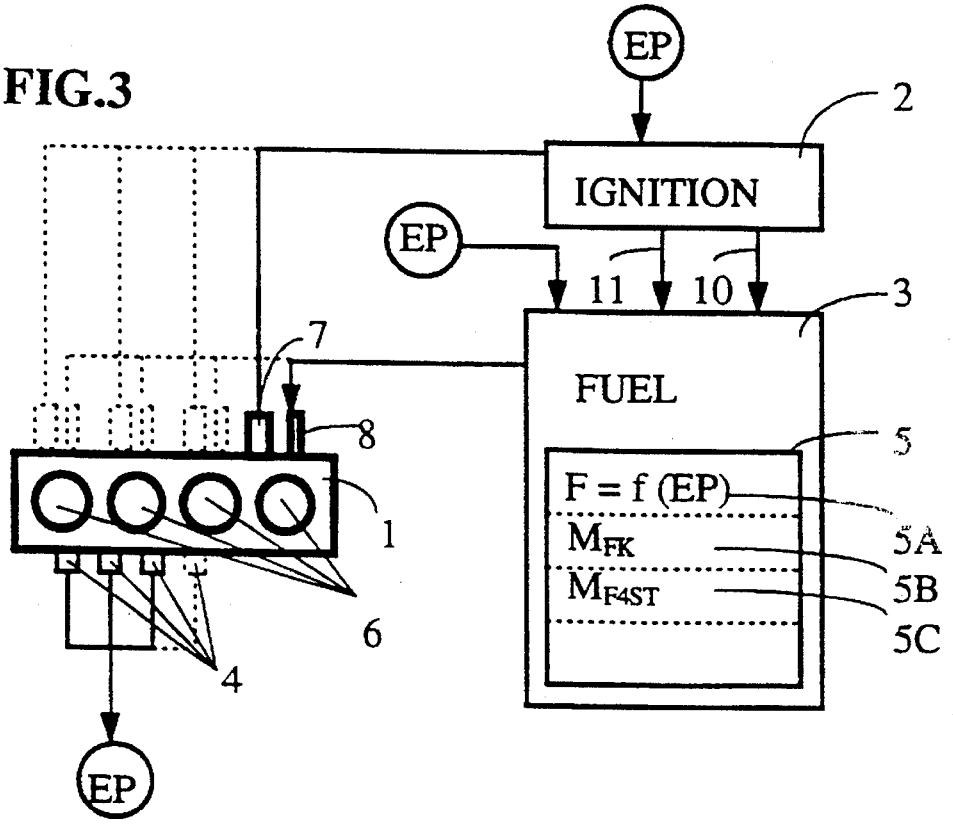
FIG. 3 shows schematically a system used for the performance of the inventive method.

In FIG. 3 is shown a system used for the performance of the method according claim 1. The combustion engine is here shown having four cylinders 6, but engines having different number of cylinders could be used. A number of engine parameters EP such as speed, load and engine temperature are detected with a number of sensors amounted on the engine.

The combustion engine, preferably an Otto-engine, is here equipped with an ignition system having a microcomputer controlled ignition control unit 2 and at least one spark plug for each cylinder. The ignition spark in the ignition plug is generated in a conventionally manner by the ignition control unit 2 and an ignition coil 7 where the ignition voltage is induced. The ignition coil could be a common coil for all of or a part of the spark plugs in the engine. A system corresponding to the system shown in EP,B,188180 is preferably used, having an ignition coil mounted on top of each ignition plug without any ignition cables between the ignition coil and the spark plug. The ignition timing is conveniently obtained in a conventionally manner from a map contained in the ignition control unit 2. The ignition timing-obtained from the map is set to a crankshaft position before the upper dead centre, dependent on the detected engine parameters EP.

The combustion engine is furthermore equipped with a microcomputer controlled fuel control unit 8 having preferably one fuel injector nozzle 8 for each cylinder 6. The amount of fuel supplied is controlled by the fuel control unit 3, sending a pulse to an electrically controlled valve, possibly an electromagnetic valve, included in the injector 8. The pulse width corresponds to the amount of fuel supplied. At least one injector is preferably used for each cylinder, a so called multi-point injection system. A common injector for all cylinders, a so called single point injection system, could alternatively be used. Determination of the pulse width, i.e. the amount of fuel supplied, is preferably performed in a conventionally manner by the fuel control unit 3. The pulse width is obtained from an empirically established map stored in the fuel control unit, where the necessary pulse width is dependent on the detected engine parameters EP. The map F=f(EP) from which the necessary amount of fuel is obtained, i.e. pulse width, is stored in a part 5A of a memory 5 of the fuel control unit 3. The fuel control unit 3 also obtains information regarding a misfiring or four-stroking condition and a knocking condition at input data lines 10 respectively 11. In the preferred embodiment a misfiring condition is as well as a knocking condition detected by the ignition system 2, which measures the ionisation current in the spark plug gap using an arrangement as shown in EP,B,188180. No additional sensors are thus needed, such as vibration sensitive sensors mounted on the engine block (for detection of a knocking condition) or sensors for detection of misfiring conditions. A misfire condition could be detected using different methods, which for example could use pressure sensors arranged in the combustion chamber or by using different types of circuitry or software capable of detecting crankshaft speed irregularities.

The memory of the fuel control unit also includes memory locations **5*b* and 5*c***, for a temporary storage of the lean limit value $M_{FK}$ and the rich limit value $M_{F4ST}$, respectively . The different parameters C, ΔC, the margin factor K, the correction factor $K_F$ and the control increments $\Delta F^+$, $\Delta F^-$, ΔFR are also stored in the memory. The control increments $\Delta F^+$, $\Delta F^-$,ΔFR and C, ΔC are preferably stored in the memory as fixed and non erasable predetermined constants, preferably a memory location of a PROM-type. $M_{FK}$, $M_{F4ST}$, the margin factor K and the correction factor $K_F$ are preferably stored in an alterable but volatile part of the memory, which could be a RAM-type of memory. These volatile parameters will thus disappear each time the control system is deactivated. At each start up the control will commence with the non-corrected parameters obtained from the map. A new establishment of $M_{FK}$, $M_{F4ST}$, the margin factor K and the correction factor $K_F$ will be made after each start-up. In this way is a new correction scheme implemented at each start-up. This could be motivated for example if refuelling have been made of a different fuel quality, or if the engine temperature changes or if the gap size in the spark plug gap is altered.

In an alternative embodiment at least the margin factor K and/or the correction factor $K_F$, which factors have been established from limit values $M_{FK}$ and $M_{F4ST}$ obtained from a preceding operation period, could be stored in alterable but non-volatile memories. At each start up the fuel control will commence with fuel amounts corrected by these factors, and following determinations of $M_{FK}$ and $M_{F4ST}$ could establish new factors K respectively $K_F$.

The four-stroking condition as well as a knocking condition is both preferably detected using the spark plug. The ionisation current in the spark plug gap could be analysed in a measuring window open during the post ionisation phase that follows the ignition voltage break down phase. A knocking condition could be detected by filtering out a characteristic frequency content, representative for a knocking phenomenon, from the ionisation current during the post ionisation phase. A four-stroking or misfiring condition could be detected from the ionisation current, by the fact that no ionisation current will be developed during a misfire event. A circuitry integrated in the ignition system corresponding to the circuitry shown in EP,B,188180, could in this respect be implemented. Rather modest additional costs are incurred for the ignition system in question, essentially caused by some minor circuits having a limited number of for this purpose necessary discrete type of electronic components.

The invention could be modified in a number of embodiments beyond the embodiment shown. For example the rich limit sequence could be initiated before the lean limit sequence, i.e. the rich limit value is determined before the lean limit value. When the present range between the lean limit value and the rich limit value once have been determined, subsequent control could be performed where only the lean limit value is updated, or that the rich limit value is updated at considerably longer intervals. The increment ΔFR used in the return sequence do not necessarily have to be performed in discrete steps dependent of the occurrence of a number of combustions. The return sequence could instead be executed as a time dependent function, for example in such a way that the return sequence is performed as a linear control over a time period. If the determination of the lean limit value and the rich limit value should be made as fast as possible, at the expense of a smooth control of the engine, the return sequence to the set value of the map or the corrected value $F_{korr}$ could be made in one single step. The hold parameter C could instead of a number of combustions correspond to a time period, where the factor ΔC corresponds to a predetermined or speed dependent time period, during which the latest initiated reduction or increase of the fuel amount should be allowed to come into effect, before the next reduction or increase of the fuel amount is initiated.

The empirically determined amount of fuel could instead from a map be given from a neural net, which neural net has been trained to give the desired output signal, i.e. fuel amount, dependent of the engine parameters detected.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

We claim:

1. Method for fuel control in two-stroke combustion engines, comprising:

(a) supplying an empirically determined fuel amount ($F_{tab}$) to the engine dependent on detected engine parameters;

(b) reducing the fuel amount in step (a) by a reduction ($\Delta F^-$) in the lean direction of the empirically determined amount of fuel ($F_{tab}$) until a knocking condition occurs;

(c) storing in memory as a lean limit value ($M_{FK}$) the value corresponding to the reduced amount of fuel supplied when the knocking condition occurs;

(d) increasing the fuel amount supplied in step (b) by an increase ($\Delta F^+$) in the rich direction of the empirically determined amount of fuel ($F_{tab}$ ) until the two-stroke engine starts four-stroking due to misfire;

(e) storing in the memory as a rich limit value ($M_{F4ST}$) the value corresponding to the increased amount of fuel supplied when the four-stroking condition occurs;

(f) calculating an adaptive set value for the fuel amount ($F_{korr}$), which adaptive set value lies at a predetermined level between the rich limit value ($M_{F4ST}$) and the lean limit value ($M_{FK}$);

(g) storing the adaptive set value ($F_{korr}$) in the memory; and (h) comparing the adaptive set value ($F_{korr}$) with the empirically determined amount of fuel ($F_{tab}$) and, when a deviation occurs between these values, correcting the empirically determined amount of fuel proportionally to the deviation between the adaptive set value ($F_{korr}$) and the empirically determined amount of fuel ($F_{tab}$).

2. Method according to claim 1, wherein after step (c) the amount of fuel is returned to the empirically determined amount of fuel ($F_{tab}$), and after step (g) the amount of fuel is adjusted to the corrected amount of fuel which has been corrected dependent on the adaptive set value ($F_{korr}$).

3. Method according to claim 2, wherein the return to the empirically determined amount of fuel ($F_{tab}$ ) or to the corrected amount of fuel which has been corrected dependent on the adaptive set value ($F_{korr}$) is performed in increments.

4. Method according to claim 3, wherein the return to the empirically determined amount of fuel ($F_{tab}$) or to the corrected amount of fuel which has been corrected dependent on the adaptive set value ($F_{korr}$) is performed in increments (ΔFR) of a larger size than the increments performed during the increase ($\Delta F^+$) or reduction ($\Delta F^-$) in steps (b) and (d), respectively.

5. Method according to claim 4 characterized in that the gradual increase or reduction in increments ($\Delta F^+$and $\Delta F^-$, respectively) is performed such that each incremental change is maintained during a predetermined number of combustions (ΔC).

6. Method according to claim 5, wherein the predetermined number of combustions (ΔC) is in the interval 30–100 combustions, so that any dynamic effect caused by the incremental change is given time to attenuate properly.

7. Method according to claim 1, wherein the four-stroking condition as well as the knocking condition is detected by analyzing an ionization current developed in a spark plug gap of the combustion engine in a measuring window open during a post-ionization phase following a break down phase of an ignition voltage.

8. Method according to claim 1, wherein steps (b) and (d) are initiated when the engine is in a substantially constant steady state condition without any substantial changes in speed or load.

9. Method according to claim 1, wherein steps (b) and (d) are performed a repeated number of times during a continuous operating period of the engine, which repetition rate is determined by a predetermined function which will restrict the number of determinations made over a time period, such that the determinations of the lean limit value ($M_{FK}$) and the rich limit value ($M_{F4ST}$) are made during fractions of the operating period of the engine, said fractions being below 5% of the total operating period.

10. Method according to claim 9, wherein said fractions are less than 1% of the total operating period.

11. System for controlling the amount of fuel supplied in two-stroke combustion engines, which comprises:

a microprocessor based control unit having a memory containing a map of predetermined amounts of fuel dependent on at least different detected engine speeds and loads;

means for detecting a knocking condition and for delivering to the control unit a signal representative of the knocking condition;

means for detecting a misfire or four-stroking condition and for delivering to the control unit a signal representative of the misfire or four-stroking condition;

means in the control unit for a successive control in the lean direction of the fuel supplied and, when a signal representative of a knocking condition occurs, for allocating a value to a lean limit parameter ($M_{FK}$) representative of the present amount of fuel supplied;

means in the control unit for a successive control in the rich direction of the fuel supplied and, when a signal representative of a misfire or four-stroking condition occurs, for allocating a value to a rich limit parameter ($M_{F4ST}$) representative of the present amount of fuel supplied; and means in the control unit for calculating a corrected amount of fuel ($F_{korr}$), which corrected amount of fuel is established dependent on a predetermined relative level in relation to the allocated values of the rich limit parameter ($M_{F4ST}$) and the lean limit parameter ($M_{FK}$), and where the corrected amount of fuel ($F_{korr}$) is substituted for the fuel amount given by the map during further continuous operation of the engine.

* * * * *